US011873700B2

(12) United States Patent
Samuelson et al.

(10) Patent No.: US 11,873,700 B2
(45) Date of Patent: Jan. 16, 2024

(54) REMOVABLE NOZZLE FOR A DOWNHOLE VALVE

(71) Applicants: Marc Samuelson, Houston, TX (US); Kyle Henagan, Houston, TX (US); James Doane, Friendswood, TX (US)

(72) Inventors: Marc Samuelson, Houston, TX (US); Kyle Henagan, Houston, TX (US); James Doane, Friendswood, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 45 days.

(21) Appl. No.: 17/579,418

(22) Filed: Jan. 19, 2022

(65) Prior Publication Data

US 2022/0228463 A1 Jul. 21, 2022

Related U.S. Application Data

(60) Provisional application No. 63/139,631, filed on Jan. 20, 2021.

(51) Int. Cl.
*E21B 34/06* (2006.01)
*E21B 23/00* (2006.01)
(Continued)

(52) U.S. Cl.
CPC ..... *E21B 34/142* (2020.05); *E21B 23/00* (2013.01); *E21B 34/06* (2013.01); *E21B 34/063* (2013.01);
(Continued)

(58) Field of Classification Search
CPC ..... E21B 2200/02; E21B 33/00; E21B 23/00; E21B 34/06; E21B 41/0078
See application file for complete search history.

(56) References Cited

U.S. PATENT DOCUMENTS 3,129,777 A * 4/1964 Haspert ..... E21B 10/61 285/321
4,323,130 A * 4/1982 Dennis ..... E21B 10/62 175/429
(Continued)

FOREIGN PATENT DOCUMENTS

CN 204738801 U 11/2015
EP 0163590 A1 4/1985
WO 2010077838 A2 7/2010

OTHER PUBLICATIONS

International Search Report and Written Opinion Issued in International Application No. PCT/US2022/014854 dated Apr. 27, 2022; 9 Pages.
(Continued)

*Primary Examiner* — Catherine Loikith
(74) *Attorney, Agent, or Firm* — CANTOR COLBURN LLP

(57) ABSTRACT

A method of manufacturing a valve of a tool for use downhole includes changing a flow characteristic of the valve. A load is applied to a first nozzle secured in a housing of the valve via a first release member, wherein a magnitude of the load is greater than a release threshold of the first release member, to release the first release member. The first nozzle is removed from the housing, and a second nozzle is secured in the housing via a second release member.

15 Claims, 6 Drawing Sheets

(51) Int. Cl.
*E21B 34/14* (2006.01)
*E21B 41/00* (2006.01)

(52) U.S. Cl.
CPC ..... *E21B 41/0078* (2013.01); *E21B 2200/02* (2020.05); *E21B 2200/06* (2020.05)

(56) References Cited

U.S. PATENT DOCUMENTS

| | | | | |
|---|---|---|---|---|
| 4,793,426 | A | 12/1988 | Millsapps, Jr. | |
| 5,526,884 | A | 6/1996 | Lembcke | |
| 5,906,245 | A | 5/1999 | Tibbitts et al. | |
| 6,192,999 | B1 | 2/2001 | Nguyen | |
| 6,227,316 | B1 | 5/2001 | Rohde | |
| 6,311,793 | B1 | 11/2001 | Larsen et al. | |
| 7,243,728 | B2 | 7/2007 | Stoesz et al. | |
| 7,735,582 | B2 | 6/2010 | Smith | |
| 7,954,568 | B2 | 6/2011 | Bilen | |
| 9,593,542 | B2 * | 3/2017 | Getzlaf | E21B 17/14 |
| 2006/0065395 | A1 | 3/2006 | Snell | |
| 2009/0205870 | A1 | 8/2009 | Smith | |
| 2022/0243554 | A1 | 8/2022 | Slup et al. | |
| 2022/0268130 | A1 | 8/2022 | Doane et al. | |

OTHER PUBLICATIONS

International Search Report and Written Opinion Issued in International Application No. PCT/US2022/012758 dated Apr. 29, 2022; 10 Pages.

* cited by examiner

REMOVABLE NOZZLE FOR A DOWNHOLE VALVE

CROSS-REFERENCE TO RELATED APPLICATIONS

This application claims priority to U.S. Provisional Application No. 63/139,631, filed Jan. 20, 2021, which is incorporated by reference herein in its entirety.

BACKGROUND

In the resource recovery industry, a valve tool can be disposed within a wellbore to either introduce a fluid into the wellbore or produce a fluid from the wellbore. The valve tool often has a method of varying the size of opening(s) which allow communication between the tubing and annulus. Between the time the tool is designed and installed, it may be desired to change the size opening(s), and thus the amount of flow between the tubing and annulus. Conventionally, this requires disassembly of the valve tool itself and redesigning and manufacturing new components, which is costly and inefficient. There is therefore a need to be able to change valve tool specifications without requiring disassembly of the valve tool and manufacturing of new components.

SUMMARY

In one aspect, disclosed herein is a method of manufacturing a valve of a tool for use downhole. The method includes applying a load to a first nozzle secured in a housing of the valve via a first release member, wherein a magnitude of the load is greater than a release threshold of the first release member, to release the first release member, and removing the first nozzle from the housing.

In another aspect, disclosed herein is a method of changing a flow characteristic of a valve for use downhole. The method includes applying a load to a first nozzle secured in a housing of the valve via a first release member, wherein a magnitude of the load is greater than a release threshold of the first release member, to release the first release member, removing the first nozzle from the housing, and securing a second nozzle in the housing via a second release member.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
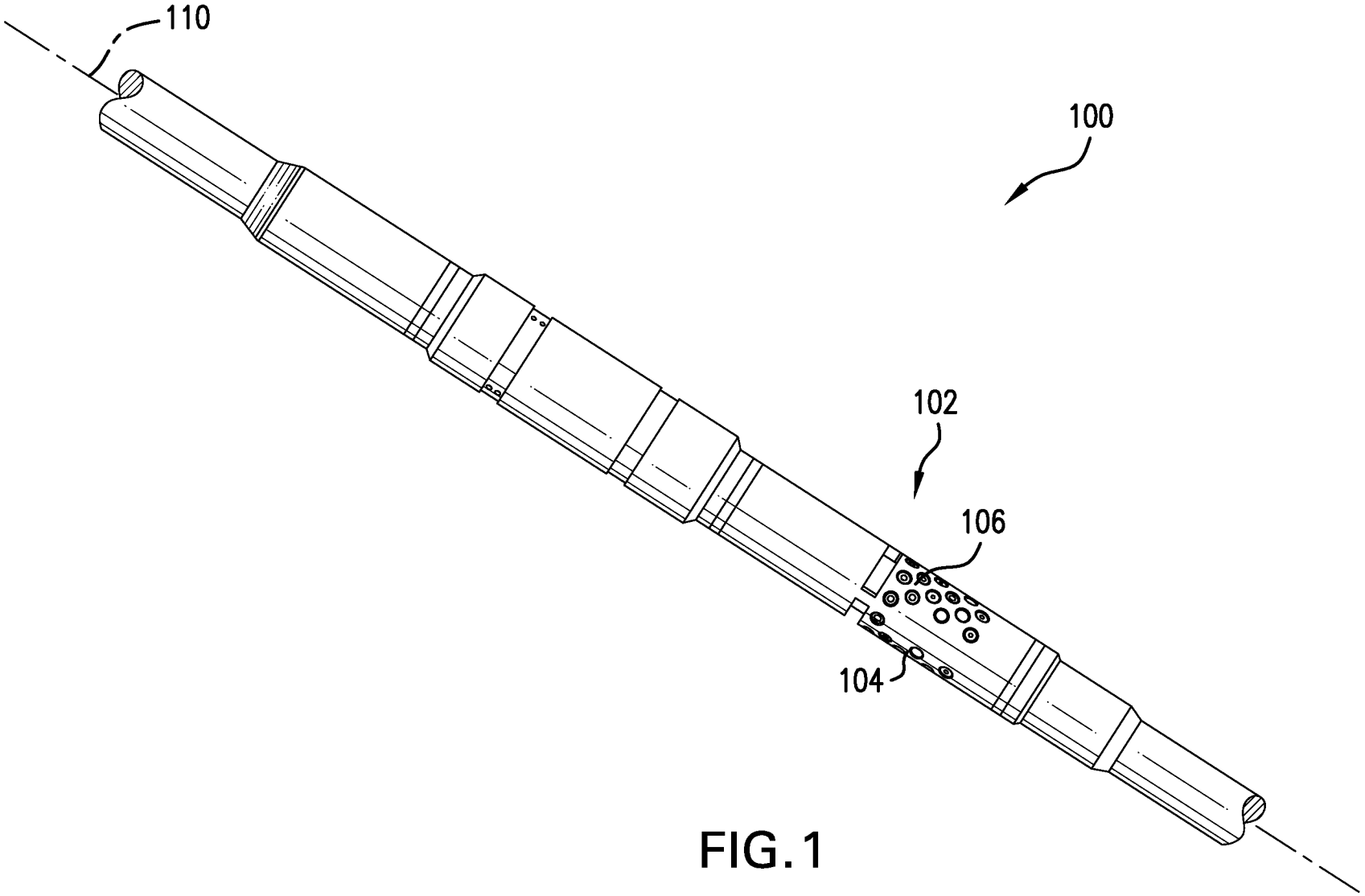
FIG. 1 shows a tool for use in a wellbore in an illustrative embodiment.

Referring to FIG. 1, a tool 100 for use downhole in a wellbore is disclosed. In various embodiments, the tool 100 can be used for drilling, production, completion, etc. The tool 100 can be a tubular member having a longitudinal axis 110. In the illustrative embodiment, the tool 100 includes a valve device 102 having a housing 104 and a plurality of nozzle assemblies 106 formed within the housing 104. The housing 104 extends along the longitudinal axis 110 of the tool 100. The plurality of nozzle assemblies 106 allow for flow of fluid through the housing 104 either from an exterior of the tool 100 to an interior of the tool 100 or from the interior to the exterior, depending on the use of the tool 100.

Figure 2:
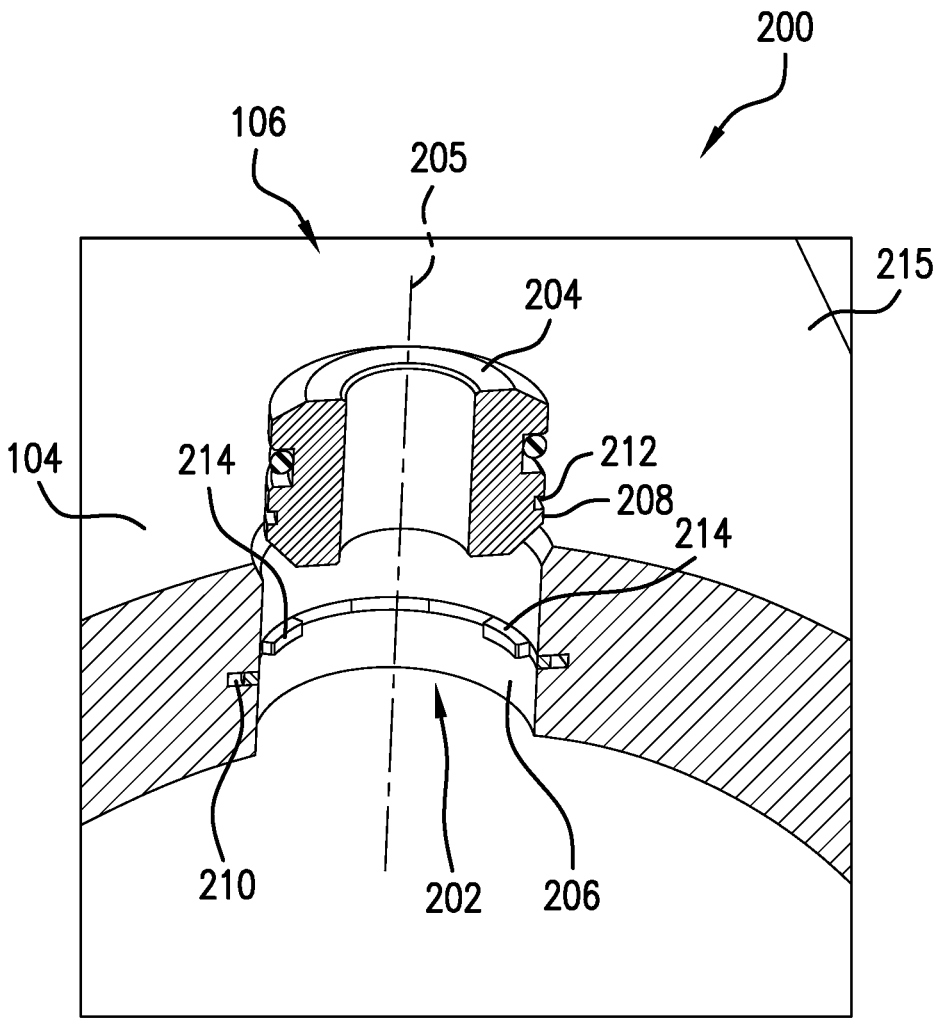
FIG. 2 shows a perspective view of a nozzle assembly.

FIG. 2 shows a perspective view 200 of a nozzle assembly 106. The nozzle assembly 106 includes a cavity, hole or orifice 202 formed in the housing 104 and a nozzle 204 that is insertable into the orifice 202. The housing 104 generally forms a cylindrical shell or opening. The orifice 202 and nozzle 204 are aligned along a nozzle assembly axis 205 that can be aligned along a radial line of the housing (i.e., a line perpendicular to longitudinal axis 110 of the housing 104). The orifice 202 forms a passage extending from an inner diameter of the cylindrical shell of the housing 104 to an outer diameter of the cylindrical shell, the passage allowing flow of fluid between an interior bore of the housing 104 and an exterior of the housing. In various embodiments the orifice 202 has an inner wall 206 centered on the nozzle assembly axis 205 and the nozzle 204 is a cylindrical body having an outer surface 208 forming a cylindrical surface of the nozzle 204. The outer surface 208 conforms to the shape of the inner wall 206. In other words, an outer diameter of the outer surface 208 is equal to or substantially equal to an inner diameter of the inner wall 206, to allow the nozzle 204 to fit snugly within the orifice 202.

A housing groove 210 is formed at the inner wall 206 of the orifice 202. The housing groove 210 extends circumferentially around the inner wall 206 and extends away from the nozzle assembly axis 205 into the housing 104. The housing groove 210 is located at a selected distance radially inward from an outer diameter surface 215 of the housing 104 in order to protect the housing groove 210 and anything in the housing groove 210 from the downhole environment such as erosion due to fluid flowing through the nozzle 204. The nozzle 204 includes a nozzle groove 212 formed circumferentially in the outer surface 208 of the nozzle 204. The nozzle groove 212 extends radially inward from the outer surface 208. The nozzle 204 is secured within the orifice 202 by a release member 214 that is disposed in both the housing groove 210 and the nozzle groove 212. The location of the housing groove 210 in the housing 104 (i.e., away from the outer diameter surface 215) therefore protects the release member 214 from the downhole environment when the tool 100 is downhole.

Figure 3A:
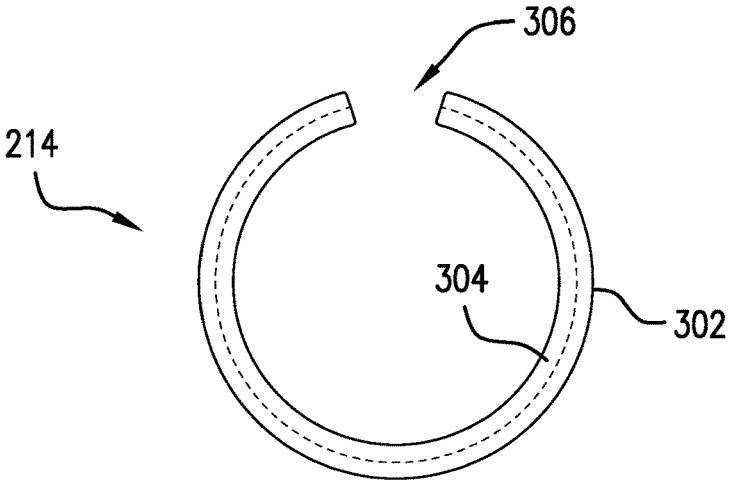
FIGS. 3A-3C shows a top view of a release member of the nozzle assembly in various embodiments.
Figure 3B:
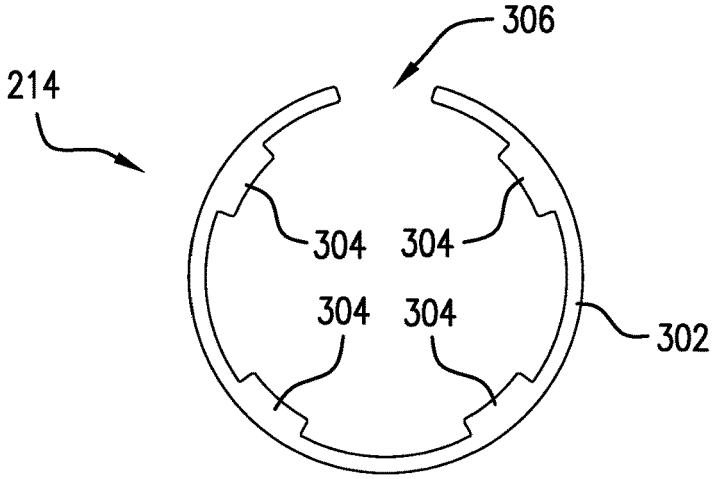
Figure 3C:
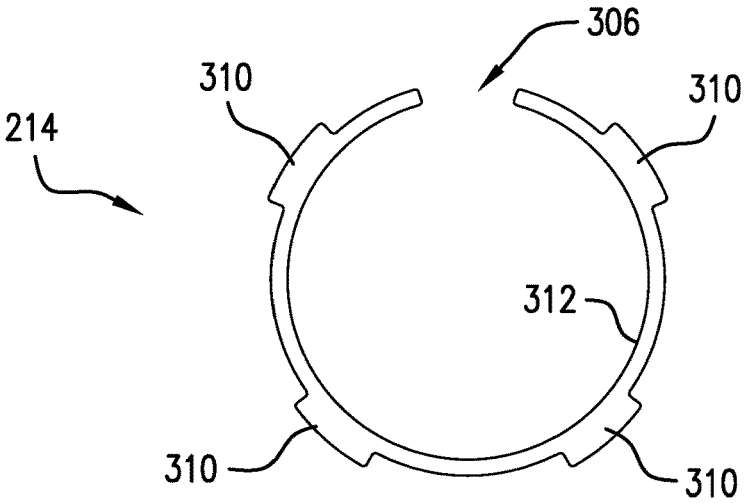

FIGS. 3A-3C shows a top view of the release member 214 in various embodiments. FIG. 3A shows an embodiment of the release member 214 with a retainer ring having a first portion (i.e., outer ring portion 302) and second portion (i.e., inner ring portion 304). The dimensions of the release member 214 are such that, when the release member 214 is in a radially relaxed state, the outer ring portion 302 resides in the housing groove 210 and the inner ring portion 304 resides in the nozzle groove 212. The release member 214 forms a semi-ring (or a ring with a gap 306 at an azimuth location along its circumference). Both the outer ring portion 302 and the inner ring portion 304 are solid along the circumference except at the gap 306.

FIG. 3B shows an embodiment of the release member 214 including radially inward tabs. The release member 214 is a retainer ring including a first portion (i.e., outer ring portion 302) and a second portion (i.e., tabs 304) protruding radially inward from the outer ring portion 302. The outer ring portion 302 forms a semi-ring (or a ring with a gap 306 at an azimuth location along its circumference). In an embodiment, the protrusions or tabs 304 are equally spaced about the inner surface of the outer ring portion 302. While shown with four tabs 304 for illustrative purposes, the retainer ring can have any number of tabs protruding from the inner surface of the outer ring portion, in various embodiments.

FIG. 3C shows an embodiment of the release member 214 including radially outward tabs. The release member 214 is a retainer ring including a first portion (i.e., tabs 310) and a second portion (i.e., inner ring portion 312), with the tabs 310 protruding radially outward from the inner ring portion 312. The inner ring portion 312 forms a semi-ring (or a ring with a gap 306 at an azimuth location along its circumference). In an embodiment, the protrusions or tabs 310 are equally spaced about the outer surface of the inner ring portion 312. While shown with four tabs 310 for illustrative purposes, the retainer ring 214 can have any number of tabs protruding from the outer surface of the inner ring portion 312, in various embodiments.

In other embodiments, the release member can be a garter spring or an O-ring. In various embodiments, the release member is able to expand and contract radially in order to move radially within housing groove 210 and nozzle groove 212 when the nozzle is being inserted into the orifice 202.

Referring back to FIG. 2, a method of securing the nozzle 204 within the orifice 202 using the release member 214 is now discussed. The method is discussed with respect to using the release member 214 of FIG. 3B for illustrative purposes only. The release members shown in FIGS. 3A and 3C can secure the nozzle 204 within the orifice 202 using the same or similar method. To secure the nozzle 204 within the orifice 202, the release member 214 is placed within the housing groove 210 of the orifice 202. The release member 214 is lowered into the orifice 202 in a slightly radially compressed state. The gap 306 can be reduced to allow the release member 214 to compress. When the release member 214 reaches the housing groove 210, it expands into the housing 104 so that the outer ring portion 302 is within the housing groove 210 and the tabs 304 are outside the housing groove 210, extending radially inward. The housing groove 210 has a depth that allows the release member 214 to expand radially outward. Once the release member 214 is in place within the housing groove 210, the nozzle 204 is lowered into the orifice 202. As the nozzle 204 is lowered into the orifice 202, a tapered inlet end of the nozzle 204 pushes the tabs 304 radially outward to expand the release member 214 outward into the housing groove 210. When the nozzle groove 212 becomes axially aligned with the housing groove 210, the release member 214 contracts to a radially relaxed state in which the outer ring portion 302 is within the housing groove 210 and the tabs 304 are within the nozzle groove 212, thereby securing the nozzle 204 in the orifice 202.

Figure 4:
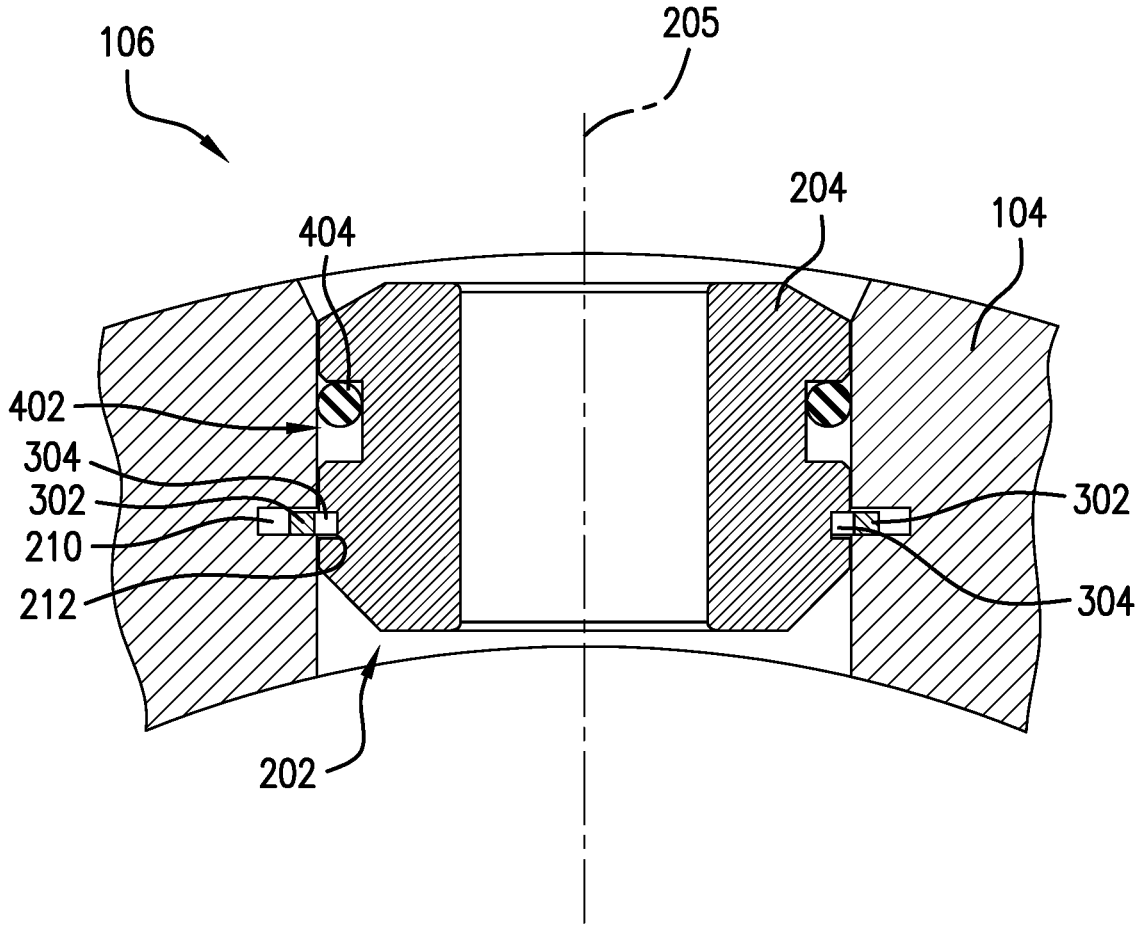
FIG. 4 shows a side cross-sectional view of the nozzle assembly with the nozzle installed in the orifice.

FIG. 4 shows a side cross-sectional view 400 of the nozzle assembly with the nozzle 204 installed in the orifice 202. The nozzle 204 is disposed in the orifice 202 such that the nozzle groove 212 and the housing groove 210 are aligned axially along axis 205. The release member 214 is disposed with its outer ring portion 302 within the housing groove 210 and the tabs 304 extending into the nozzle groove 212. The nozzle 204 includes a seal groove 402 axially located between an outlet end of the nozzle and the nozzle groove 212. An O-ring 404 located in the seal groove 402 seals any gap between the nozzle 204 and inner wall 206, thereby prevent a flow of fluid through the gap between outer surface 208 of the nozzle 204 and the inner wall 206 of the orifice 202, thereby preventing erosion of the release member 214.

Figure 5:
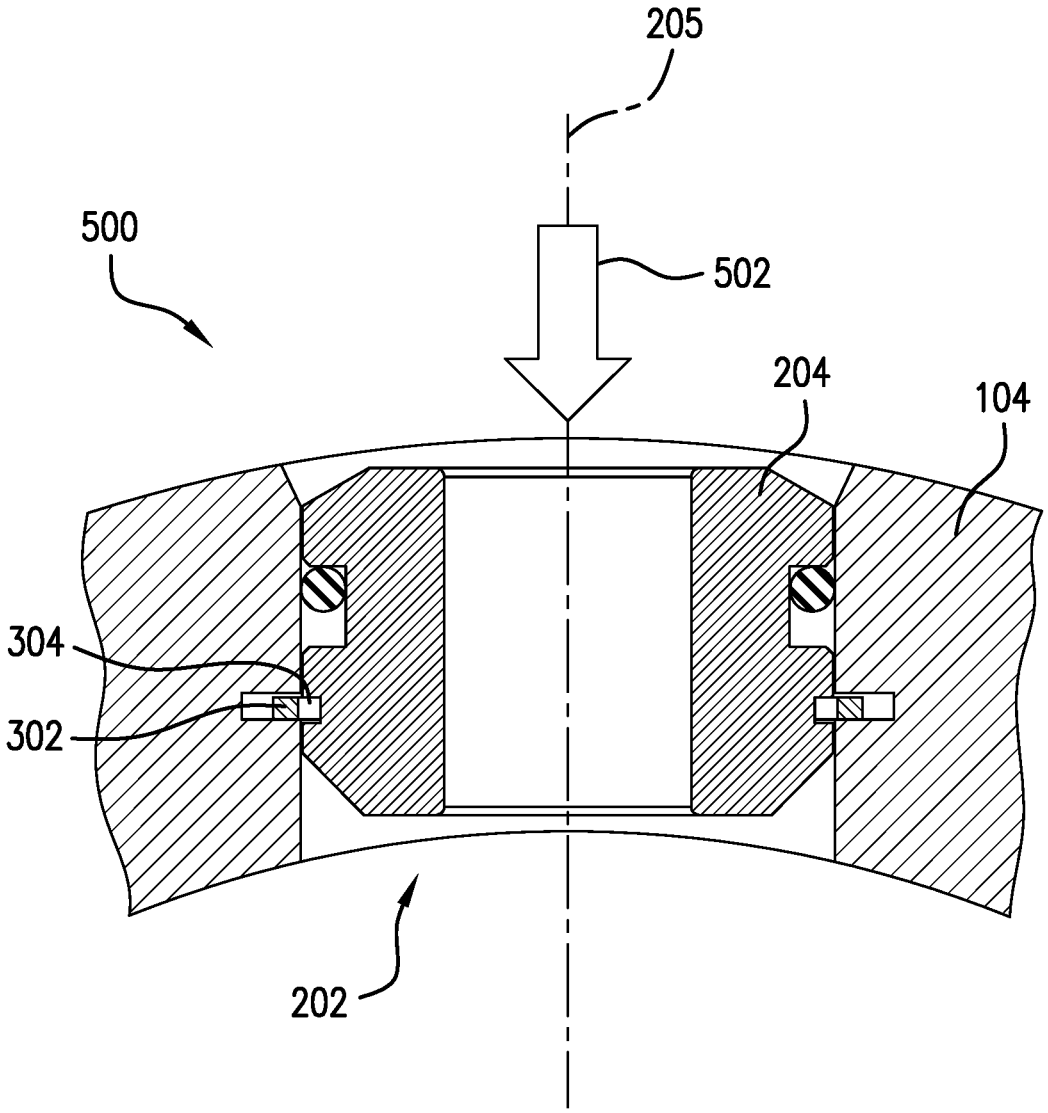
FIG. 5 illustrates an action for removing the nozzle from the orifice.

FIG. 5 illustrates an action 500 for removing the nozzle 204 from the orifice 202. A force or load 502 is applied to the nozzle 204 along the nozzle assembly axis 205. The load 502 applies a shear force at the release member 214 by forcing the tabs 304 in one direction along the nozzle assembly axis 205 while the outer ring portion 302 is maintained at its location in the housing groove 210. When a magnitude of the load 502 is above a release threshold of the release member 214, the tabs 304 separate from the outer ring portion 302, thereby freeing the nozzle 204 from the housing 104 and allowing the nozzle 204 to be removed from the housing 104.

Figure 6:
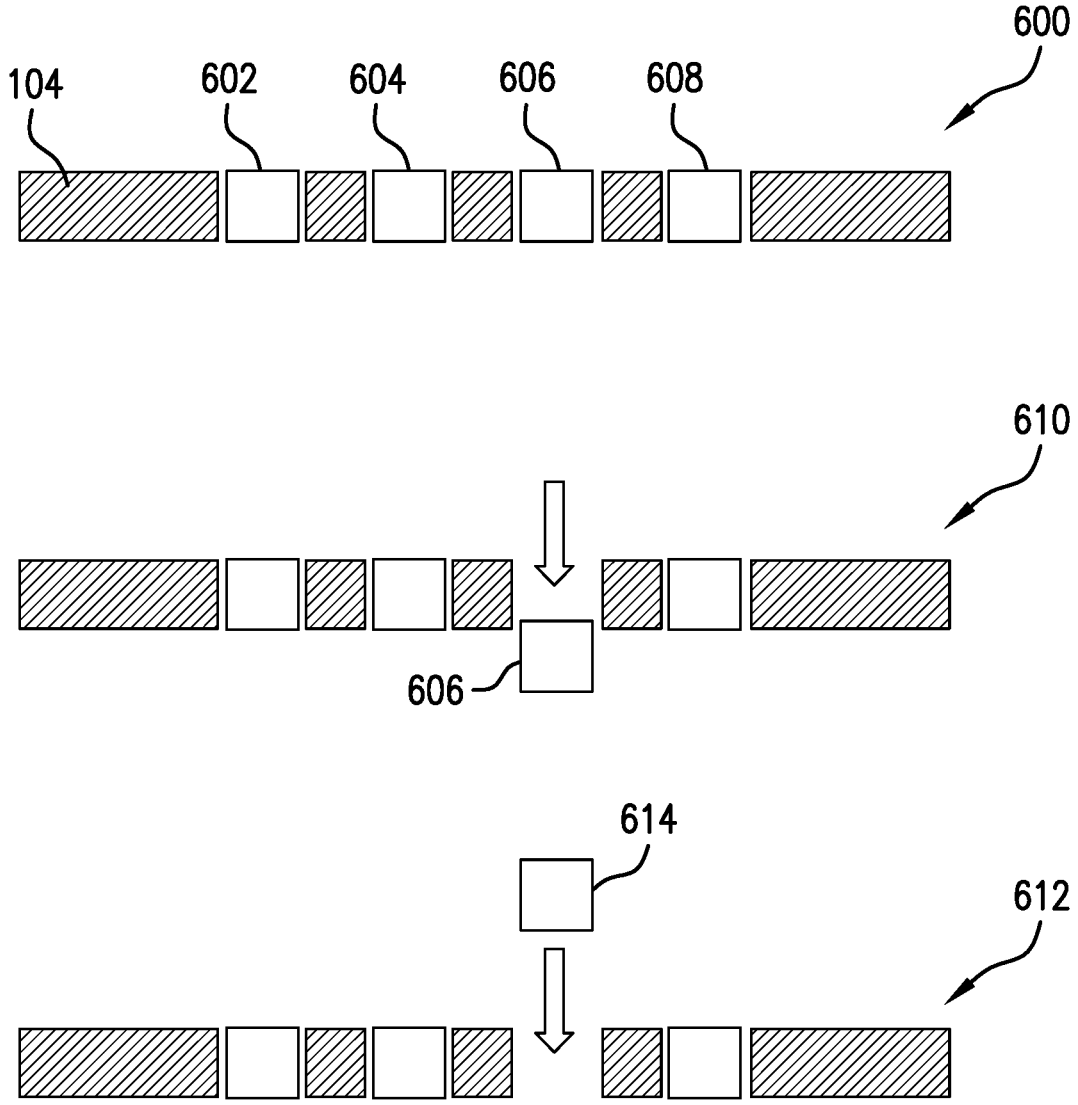
FIG. 6 illustrates steps for manufacturing a valve of a downhole tool using the nozzle and nozzle assembly disclosed herein.

FIG. 6 illustrates steps 600, 610 and 612 for disassembling and reassembling a valve of a downhole tool using the nozzle and nozzle assembly disclosed herein. The illustrative valve includes a housing 104 with a plurality of nozzles 602, 604, 606 and 608 disposed therein, with each nozzle 602, 604, 606 and 608 having different values of flow characteristics. Some examples of flow characteristics are flow area, valve coefficient, orifice coefficient and nozzle shape. For illustrative purposes only, the flow characteristic is discussed as being a flow area. The nozzles 602, 604, 606 and 608 can be assembled in any selected order based on a current knowledge of a downhole environment in which the valve is to be used. When the knowledge of the downhole environment is updated or improves, a valve designer or user can select to change out one or more nozzles prior to disposing the valve downhole. The nozzle assembly disclosed herein allows for the user to interchange nozzles as more information about the downhole environment is received. The nozzles 602, 604, 606 and 608 can be changed out without disassembling the valve itself.

In a first step 600, the housing 104 is shown with nozzles 602, 604, 606, 608 which are disposed within respective orifices. The nozzles are placed within their orifices using the release member and methods disclosed hereinabove. The nozzles 602, 604, 606 and 608 can have selected flow areas. For illustrative purposes, nozzle 602 has a 0.25 $in^2$ flow area, nozzle 604 has a 0.50 $in^2$ flow area, nozzle 606 has a 0.75 $in^2$ flow area and nozzle 608 has a 1.00 $in^2$ flow area. As new information comes in regarding the downhole environment, the valve designer can make changes in the nozzle arrangement. For example, the valve designer can decide that nozzle 606 should also have a 1.00 $in^2$ flow area, rather than a 0.75 $in^2$ flow area are original designed. In a second step 610, the nozzle 606 is removed by applying a longitudinal force on the nozzle 606 that is greater than a release threshold of the release member, thereby releasing the release member by shearing the release member. The nozzle 606 is then allowed to easily slide out of its orifice. In a third step 612, a new release member (such as shown in FIGS. 3A-3C) is placed within the orifice and a new nozzle (e.g., a nozzle 614 having a 1.00 $in^2$ flow area) is lowered into the orifice to be secured within the housing 104 using the new release member.

While the tool is discussed herein as securing a nozzle within an orifice using a release member to form a nozzle assembly, the release member can be used to secure any suitable device or member within the housing or within a tool.

Set forth below are some embodiments of the foregoing disclosure:

Embodiment 1: A method of manufacturing a valve of a tool for use downhole. The method includes applying a load to a first nozzle secured in a housing of the valve via a first release member, wherein a magnitude of the load is greater than a release threshold of the first release member, to release the first release member, and removing the first nozzle from the housing.

Embodiment 2: The method of any prior embodiment, wherein the first nozzle is disposed within an orifice of the housing, further comprising applying the load to the first nozzle along a longitudinal axis of the orifice.

Embodiment 3: The method of any prior embodiment, further comprising securing a second nozzle in the orifice.

Embodiment 4: The method of any prior embodiment, wherein a first value of a flow characteristic of the first nozzle is different than a second value of the flow characteristic of the second nozzle.

Embodiment 5: The method of any prior embodiment, wherein the flow characteristic is a flow area.

Embodiment 6: The method of any prior embodiment, wherein the first release member includes a retainer ring having an outer ring portion disposable within a housing groove of the housing and a tab disposable within a nozzle groove of the first nozzle, further comprising applying the load to the first nozzle to separate the tab from the outer ring portion.

Embodiment 7: The method of any prior embodiment, wherein the release member is configured to expand and contract radially.

Embodiment 8: The method of any prior embodiment, further comprising securing the second nozzle in the valve by placing a second release member in the housing groove and moving the second nozzle along the orifice to locate the nozzle groove alongside the housing groove to receive the second release member.

Embodiment 9: The method of any prior embodiment, wherein the release member is one of: (i) a garter spring; and (ii) an O-ring.

Embodiment 10: A method of changing a flow characteristic of a valve for use downhole. The method includes applying a load to a first nozzle secured in a housing of the valve via a first release member, wherein a magnitude of the load is greater than a release threshold of the first release member, to release the first release member, removing the first nozzle from the housing, and securing a second nozzle in the housing via a second release member.

Embodiment 11: The method of any prior embodiment, wherein the first nozzle is disposed within an orifice of the housing, further comprising applying the load along a longitudinal axis of the orifice.

Embodiment 12: The method of any prior embodiment, wherein the first nozzle has a first value of a flow characteristic and the second nozzle has a second value of the flow characteristic different than the first value of the flow characteristic of the first nozzle.

Embodiment 13: The method of any prior embodiment, wherein the flow characteristic is a flow area.

Embodiment 14: The method of any prior embodiment, wherein the first release member includes a retainer ring having an outer ring portion disposable within a housing groove of the housing and a tab disposable within a nozzle groove of the nozzle, further comprising applying the load to the first nozzle to break the tab from the outer ring portion.

Embodiment 15: The method of any prior embodiment, wherein the release member is configured to expand and contract radially.

Embodiment 16: The method of any prior embodiment, further comprising securing the second nozzle in the valve by placing the second release member in the housing groove and moving the second nozzle along the orifice to locate the nozzle groove alongside the housing groove to receive a tab of the second release member.

Embodiment 17: The method of any prior embodiment, wherein the release member is one of: (i) a garter spring; and (ii) an O-ring.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of manufacturing a valve of a tool for use downhole, comprising:

applying a force to a first nozzle secured in a tubular housing of the valve via a first release member to shear the first release member, wherein the force is applied radially inward along a radial line of the tubular housing and a magnitude of the force is greater than a release threshold of the first release member; and removing the first nozzle from the housing.

2. The method of claim 1, wherein the first nozzle is disposed within an orifice of the housing, further comprising applying the load to the first nozzle along a longitudinal axis of the orifice.

3. The method of claim 2, further comprising securing a second nozzle in the orifice.

4. The method of claim 3, wherein a first value of a flow characteristic of the first nozzle is different than a second value of the flow characteristic of the second nozzle.

5. The method of claim 4, wherein the flow characteristic is a flow area.

6. The method of claim 2, wherein the first release member includes a retainer ring having an outer ring portion disposable within a housing groove of the orifice and a tab disposable within a nozzle groove of the first nozzle, further comprising applying the load to the first nozzle to separate the tab from the outer ring portion.

7. The method of claim 6, wherein the release member is configured to expand and contract radially.

8. The method of claim 6, further comprising securing a second nozzle in the valve by placing a second release member in the housing groove and moving the second nozzle along the orifice to locate the nozzle groove alongside the housing groove to receive the second release member.

9. A method of changing a flow characteristic of a valve for use downhole, comprising:

applying a force to a first nozzle secured in a tubular housing of the valve via a first release member to shear the first release member, wherein the force is applied inward along a radial line of the tubular housing and a magnitude of the force is greater than a release threshold of the first release member;

removing the first nozzle from the housing; and securing a second nozzle in the housing via a second release member.

10. The method of claim 9, wherein the first nozzle is disposed within an orifice of the housing, further comprising applying the load along a longitudinal axis of the orifice.

11. The method of claim 9, wherein the first nozzle has a first value of a flow characteristic and the second nozzle has a second value of the flow characteristic different than the first value of the flow characteristic of the first nozzle.

12. The method of claim 11, wherein the flow characteristic is a flow area.

13. The method of claim 9, wherein the first release member includes a retainer ring having an outer ring portion disposable within a housing groove of and orifice of the housing and a tab disposable within a nozzle groove of the nozzle, further comprising applying the load to the first nozzle to break the tab from the outer ring portion.

14. The method of claim 13, wherein the release member is configured to expand and contract radially.

15. The method of claim 13, further comprising securing the second nozzle in the valve by placing the second release member in the housing groove and moving the second nozzle along the orifice to locate the nozzle groove alongside the housing groove to receive a tab of the second release member.

* * * * *